United States Patent [19]

Gintis et al.

[11] 4,407,889

[45] Oct. 4, 1983

[54] SPLITTABLE HOLLOW POLYESTER FILAMENT

[75] Inventors: Daniel Gintis; Elmer E. Most, Jr., both of Kinston, N.C.

[73] Assignee: E. I. Du Pont de Nemours and Company, Wilmington, Del.

[21] Appl. No.: 350,345

[22] Filed: Feb. 19, 1982

[51] Int. Cl.[3] ..... D02G 3/00

[52] U.S. Cl. ..... 428/398; 428/97; 428/400; 428/904

[58] Field of Search ..... 428/398, 400, 97, 904; 264/177 F, 171

[56] References Cited

U.S. PATENT DOCUMENTS

| | | | |
|---|---|---|---|
| 3,924,988 | 12/1975 | Hodge | 264/177 F X |
| 4,316,924 | 2/1982 | Minemura et al. | 428/397 X |

FOREIGN PATENT DOCUMENTS

| | | | |
|---|---|---|---|
| 838141 | 6/1960 | United Kingdom | 428/398 |
| 1160263 | 8/1969 | United Kingdom | 264/177 F |

*Primary Examiner*—Lorraine T. Kendell

[57] ABSTRACT

Hollow filaments having longitudinal grooves and ridges that are readily split along the grooves and are especially adapted for use in a flocking process to form flocked products with a surface similar to suede. The hollow filaments have a denier of about 0.8 to about 3.35 and have a void area of 15 to 30% of the total area of the cross section of the fiber.

7 Claims, 2 Drawing Figures

SPLITTABLE HOLLOW POLYESTER FILAMENT

BACKGROUND OF THE INVENTION

This invention relates to hollow polyester filaments especially adapted to be readily split along their length so as to produce fibers of substantially smaller denier than the denier of the original hollow filament. More particularly, this invention relates to hollow polyester filaments that may be processed through conventional flocking machines, and then split to produce a product having a texture similar to suede made by napping of leather.

It is known in the art to produce flocked materials such as wallpaper fabric and the like by projecting the flocking material in an electrostatically charged condition against a substrate having an adhesive pattern. The electrostatically charged particles of flocking material are usually of somewhat longer length than diameter and are projected in such a manner that most of the particles become fixed to the adhesive by one end. The end opposite the end fixed to the adhesive is free to move about and yield to the touch.

It is known that texture of a flocked fabric is in part a function of the denier of the filaments protruding from the substrate. In general, the smaller the denier and more numerous the filaments the more suede-like the surface. However, it is difficult to produce and handle synthetic filamentary material of the denier desired in a product simulating suede. It has now been found that it is possible to produce a texture similar to suede by producing a hollow synthetic filamentary material having grooves that run in the longitudinal direction of the filament, chopping these filaments to the desired length and projecting the resulting particles onto an adhesive coated substrate and, after curing the adhesive, fracturing the filaments by suitable mechanical working such as abrasion caused by light sanding or the like.

The filaments of the present invention are especially adapted for use in producing suede-like products in that they are made of particular compositions having a particular molecular weight range (as indicated by relative viscosity). The molecular weight range is a limiting factor for the filaments, in that it must be sufficiently high that the filaments can be processed, e.g., chopped, without splitting, but sufficiently low that the filaments will split when the surface that they form on the substrate is mechanically worked, e.g., abraded. The filaments are of such dimensions that they may readily be produced on conventional spinning equipment [only the spinneret needs to be modified]. The filaments have a central continuous longitudinally extending void and a plurality of grooves and ridges that extend the length of the filaments.

DETAILED DESCRIPTION

The filaments of the present invention are composed of a polyester, preferably a terephthalate polyester, and most preferably a terephthalate polyester selected from the class consisting of polyethylene terephthalate, and copolyesters containing 96 to 99.5 mole percent ethylene terephthalate units and 0.5 to 4 mole percent of ethylene 5-(sodium-sulfo)isophthalate units. If the polyester is polyethylene terephthalate, then its relative viscosity is preferably in the range of 8 to 12; if the polyester is a terephthalate copolyester, its relative viscosity is preferably in the range of 7 to 13. (The relative viscosity (LRV) referred to in this application is the ratio at 25° C. of the flow times in a capillary viscometer for solution and solvent. The solution is 4.75 wt. percent of polymer in solvent. The solvent is hexafluoroisopropanol containing 100 ppm of $H_2SO_4$.)

The filaments of the present invention have a denier of about 0.8 to about 3.35, and a centrally located continous longitudinally axially extending void. The void is in most embodiments circular in cross section, but the void does not have to be circular in order to achieve the desired splittable fiber. The void has an area in the range of about 15 to 30% of the total cross-sectional area of the filament as determined from measurements on a cross section cut at a right angle to the axis of the filament.

Figure 1:
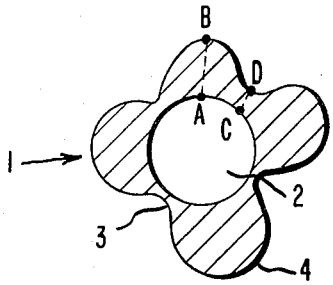
FIG. 1 is a typical cross section of a four-grooved, four-ridged hollow filament made according to the invention. The lettering is used hereinafter to explain how "groove ratio" is determined.

The filament of the present invention has a corrugated outer surface, that is, the filament's outer surface is composed of a plurality of ridges and grooves that run the length of the filament. The ridges are the thick and strong portions of the filament and the grooves are the thin and weak portions of the filament. Thus, the filament because of relative difference in strength between the groove and ridge will tend to split along the groove when mechanically worked. In order to insure that the difference in thickness is sufficiently great that the filament will split along the groove lines when mechanically worked, but not so great that it cannot be manipulated without premature splitting, it has been found that the ratio of wall thickness of a ridge to wall thickness of a groove must be in the range of 1.7 to 2.3. This ratio, hereinafter called "groove ratio", is determined by cutting the filament at a right angle to the longitudinal dimension of the filament and then measuring radially the shortest distance from the perimeter of the void to the bottom of the groove, and the shortest distance from the perimeter of the void to the top of the ridge. Since filaments are not always symmetrical, the ratio is best obtained by making several measurements along the filaments and then averaging the measurements. FIG. 1 is illustrative of how the measurements are made. FIG. 1 is a cross section of a hollow filament 1 cut at right angles to the longitudinal dimension of the filament. The filament illustrated has a void 2, four grooves 3, and four ridges 4. In the drawing, the ratio would be determined by radially measuring the distance from point A to point B, and the distance from point C to point D, and then dividing the distance from point A to B by the distance from point C to D.

Finally, in order for the drawn filaments to perform satisfactorily, it is necessary that the filaments have a break elongation of less than about 30%. Break elongation is determined on an Instron tester, Model TT-B, equipped with a Type B Instron Load Cell and Instron Type B pneumatic clamps with rubber-coated faces (Instron #2702-008). Sample bundles of 100±30 den. (111±33 dtex) are separated from the drawn rope or tow; 2 twists/in. (0.79 twists/cm) are inserted in the sample on the tester; and the sample is broken using a sample length of 10 in. (25.4 cm), a rate of extension of 6 in./min. (15.24 cm/min.), and a chart speed of 12 in./min. (30.48 cm/min.). Break elongation is calculated as the ratio of specimen extension to specimen length expressed as percent. Filaments having a break elongation greater than about 30% will not split along the grooves with sufficient ease to make a satisfactory product.

The filaments of this invention may have from 2 to 8 ridges and a corresponding number of grooves. Preferably the filaments have 3 to 8 ridges, and most preferably 6 ridges.

The centrally located void in the spun filament may be in the form of a triangle, square, hexagon or pentagon. Because of the surface tension of the converging streams of molten polymer that come together to form the hollow filament, the points of the triangle, square, etc., tend to be rounded.

The hollow filaments are produced by spinning clusters of molten streams from a spinneret. Usually a cluster of molten streams is three or more, but two molten streams from arc-shaped slots may be employed to produce a hollow filament. The molten streams bulge as they leave the face of the spinneret, and the bulges of the various streams touch and unite (coalesce) to form the desired hollow filament. This bulging phenomenon is known in the art as die swell. The individual streams of the cluster are separated sufficiently far apart at the surface of the spinneret that air passes between the streams and fills the volume between them. Normally the distance between the various adjacent holes of the cluster in a spinneret will be between 0.0254 mm and 0.127 mm. The distance between the various adjacent orifices that make up the cluster of orifices in the spinneret that produce a hollow filament can be varied somewhat, depending upon the size and shape of the orifice in the spinneret, the temperature of the atmosphere surrounding the streams, the temperature of the polymer being extruded, the temperature of the spinneret, the viscosity of the polymer, etc. It is important that gas (usually air) be able to pass between the streams of a cluster as they are leaving the spinneret, and that the streams contact adjacent streams of the cluster while they are still sufficiently tacky that they will form a bond. Spinning equipment known in the art for spinning hollow filaments can be employed with modification to produce the filaments of this invention. After the spinning operation is complete, the void volume in the filaments can be increased by passing the filaments continuously at low tension through a water bath maintained at about 100° C. This process is disclosed and claimed in another of assignee's patent application, Ser. No. 350,346, filed of even date. The filaments should be in this water bath for a minimum of about 3 seconds. The filaments may be stretched lengthwise without orienting them under these conditions. The filaments may then be drawn in a conventional manner. For good drawability and maximum increase in % void, drawing should begin within seven days of the time the filament is spun.

Figure 2:
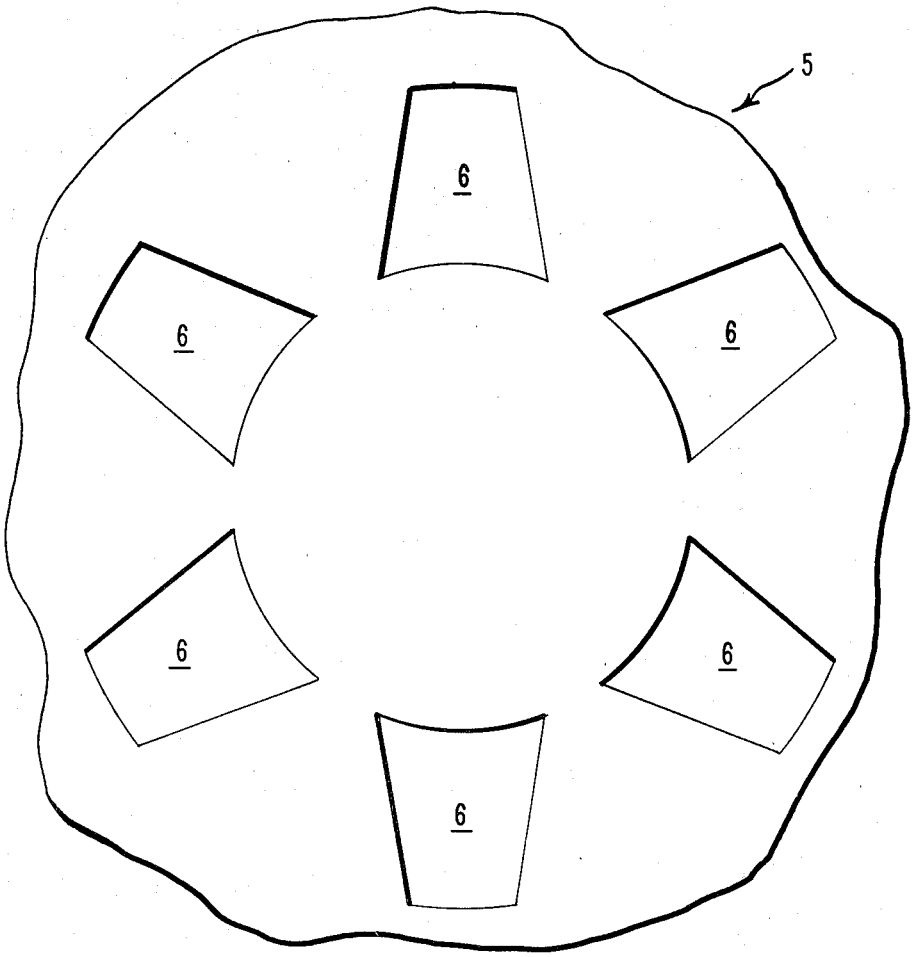
FIG. 2 is a portion of a spinneret face showing one cluster of six apertures that may be used to produce a hollow filament having six ridges.

FIG. 2 is a drawing of a portion of the face of a spinneret 5 showing a cluster of orifices 6. The cluster illustrated would produce a hollow filament having six grooves and six ridges.

In the following example which illustrates the invention, all parts are by weight unless otherwise specified.

EXAMPLE

An ethylene terephthalate polyester containing 2 mol percent of ethylene-5-(sodium sulfo)isophthalate units was spun at 1200 yards/min. (1097 m/min.) at a block temperature of about 266° C. to filaments of 11.3 LRV. The spinneret had 66 clusters of capillaries. Each cluster had the six capillaries located in a circle as in FIG. 2. The distance between adjacent capillaries along the circumference of the circle was 0.0457 mm. The area of each hole in the spinneret was about 0.0122 $mm^2$. Located about 4 meters below the spinneret was a take-up roll. The filaments were spun using an air quench temperature of about 70° C. The product was wound on tubes. Within 24 hours after spinning, the void in the filament was expanded by unwinding the filament from the tubes and passing the filament continuously into a 100° C. water bath where it resided about 10 seconds. In this water bath the filament was stretched lengthwise under low tension (without orienting the filament) about 1.6×. The product was passed continuously into a 97° C. water bath where it was drawn about 3.75× at a drawing speed of 50 ypm (45.7 m/min.). The product was wound on spools. The 1.39 denier filaments had a diameter of about 0.0134 mm and a centrally located continuous longitudinal void of circular shape. The void was about 27% of the total cross-sectional area. The filament had a groove ratio of 1.96. The filaments had a break elongation of about 15%.

A portion of the filament, 1.5 g, was cut into 6.35 millimeter lengths placed in 150 ml of water and agitated in a Waring Blender at a Powerstat setting of 75 units for 60 minutes. Photomicrographs of the product showed that the 6.35 millimeter lengths of filament usually were split along the grooves in the filament.

A sample of the above unsplit filament was processed through a conventional process where it was chopped to a length of about 0.51 mm to 0.76 mm and then electrostatically charged and applied to an adhesive coated substrate. The adhesive was then cured, and the surface was lightly hand sanded. The flocked surface was soft and had the feel of suede. Microscopic examination of the surface showed that many of the hollow filament particles had fractured along the grooves during the sanding operation.

We claim:

1. A polyester filament having a denier in the range of about 0.8 to about 3.35, and a centrally located continuous longitudinally extending void, said void having an area of 15 to 30% of the total cross-sectional area of the filament, including the void, when measured on a cross section cut at a right angle to the longitudinal axis of the filament, the outer surface of said filament having the form of a plurality of ridges that extend longitudinally of the filament and a plurality of grooves that extend longitudinally along the filament, and having a groove ratio in the range of about 1.7 to about 2.3, said filament having a break elongation of less than about 30%.

2. The filament of claim 1 in which the polyester is a terephthalate polyester.

3. The filament of claim 2 in which the polyester is a terephthalate polyester selected from the class consisting of polyethylene terephthalate having a relative viscosity of 8 to 12, and copolyesters of ethylene terephthalate units and ethylene 5-(sodium-sulfo)isophthalate units having a relative viscosity of 7 to 13.

4. The filament of claim 1 in which the number of ridges on the outer surface of the fiber is at least 3 but not more than 8.

5. The filament of claim 3 in which the filament composition is a copolyester of ethylene terephthalate units and ethylene 5-(sodium-sulfo)isophthalate units.

6. The filament of claim 5 in which the number of ridges of the outer surface of the filament is 6.

7. The filament of claim 1 in which the centrally located continuous longitudinally extending void has, when viewed at a cross section cut at right angle to the length of the filament, the approximate shape of a circle.

* * * * *